US005329787A

United States Patent [19]

Friday

[11] Patent Number: 5,329,787

[45] Date of Patent: Jul. 19, 1994

[54] COMBINATION FOOD AND BEVERAGE COOLER

[76] Inventor: Mark G. Friday, Rte. #2, Box 331, Dallas, N.C. 28034

[21] Appl. No.: 9,289

[22] Filed: Jan. 26, 1993

[51] Int. Cl.[5] ..... B67D 5/62

[52] U.S. Cl. ..... 62/389; 62/372; 62/457.1; 62/457.7; 62/530

[58] Field of Search ..... 62/457.5, 457.5, 457.7, 62/389, 371, 372, 529, 530

[56] References Cited

U.S. PATENT DOCUMENTS

| | | | |
|---|---|---|---|
| 377,675 | 2/1888 | Hays | 62/389 |
| 3,395,550 | 8/1968 | Dungan | 62/457.7 |
| 3,572,054 | 3/1971 | Curcio | 62/390 |
| 4,050,264 | 9/1977 | Tanaka | 42/457.7 |
| 4,351,165 | 9/1982 | Gottsegen et al. | 62/371 |
| 4,557,475 | 3/1986 | Herrera | 62/457 |
| 4,819,793 | 4/1989 | Willard et al. | 62/475.5 |
| 4,996,847 | 3/1991 | Zickler | 62/3.64 |
| 5,010,741 | 4/1991 | Gelatini | 62/246 |
| 5,048,639 | 9/1991 | Scherer | 182/18 |
| 5,129,552 | 7/1992 | Painchaud et al. | 222/146.6 |

*Primary Examiner*—John M. Sollecito
*Attorney, Agent, or Firm*—W. Thad Adams, III

[57] ABSTRACT

The invention relates to a combination food and beverage cooler. The cooler includes a bottom wall, a plurality of attached side walls, and a top opening defined by the side walls. The bottom wall and side walls substantially enclose a compartment area formed therein. A beverage compartment is positioned in the compartment area and adjacent the bottom wall for storing an otherwise non-contained beverage. The beverage compartment is relatively flat and extends over a relatively large surface area of the compartment area in relation to its volume. A food compartment in the compartment area stores items such as canned goods, canned drinks and other solid food items. A cooler pack in the compartment area is positioned between the food compartment and the beverage compartment for cooling the food compartment and the beverage compartment. The cooler pack extends over a relatively large surface area of the beverage compartment and the food compartment.

4 Claims, 3 Drawing Sheets

COMBINATION FOOD AND BEVERAGE COOLER

TECHNICAL FIELD AND BACKGROUND OF THE INVENTION

This invention relates to a combination food and beverage cooler with divided food and beverage compartment areas. The respective compartment areas are designed for separately containing a liquid beverage which can be dispensed directly from the compartment into a glass or cup, and items such as fruit, canned goods, canned drinks, and the like in a single portable cooler unit. The compartment areas are divided by a partition wall which has a recessed dish for housing a refreezable and detachable ice pack or "cooler pack." A tray insert is placed above the partition wall and over the cooler pack for holding the cooler pack relatively stable, and for separating the cooler pack from the items stored in the food compartment. The beverage compartment is defined by the area directly beneath the partition wall, and includes a drain/fill plug and dispenser tap.

Prior art coolers such as that disclosed by the Dungan Patent, U.S. Pat. No. 3,395,550, are inadequate for separately containing both food items and a non-contained beverage. The Dungan cooler has separate compartment areas located on either side of the cooler, as opposed to the top and bottom. Ice is placed in the side compartment area adjacent to the side beverage compartment, and within the same compartment as the food storage area. As is evident, this design presents a stability problem when the cooler is lifted and moved, since the weight distribution is extremely uneven. Additionally, a cooler of this type is not practical because of the limited food storage space above the ice needed to cool the beverage compartment.

Other conventional coolers, such as that manufactured by Coleman or Igloo, have commonly been used for containing only an otherwise non-contained beverage such as punch, cool-aid, etc. However, several problems exist in the use of these type coolers for this purpose. Ice used to chill the beverage usually melts over a relatively short period of time, and consequently acts to dilute and otherwise lessen the flavor of the beverage. Additionally, there are obvious problems of filling and dispensing the beverage from the cooler. Generally, one has to turn the entire cooler on its side in order to fill his/her cup. The cooler of the present invention provides an easy manner of filling and draining the beverage compartment area, and a tap dispenser for easily dispensing the beverage into a cup.

When a conventional cooler is packed with ice, canned drinks, and food, the food can become damp or soggy because of melted ice and improper food wrapping. A cooler according to the present invention eliminates this problem by providing a storage space for a self-contained, removable cooler pack. The cooler pack chills the cooler and remains in a relatively fixed positioned without melting over and dampening the cooler contents. Moreover, the cooler pack is refreezable, thus saving the expense of buying ice every time the cooler is used.

The size of the cooler, according to this invention, can be very large to separately accommodate food and beverage for numerous people, or quite small. Presently, industry workers, school children, and others who typically bring their lunch to work or school must carry both a thermos container and a lunch box for their drink and sandwich. This can be awkward and clumsy. Moreover, the conventional lunch box does not include a means for cooling the food compartment, nor does the thermos include a means for continuously chilling the beverage. This invention eliminates the need for individual containers by providing separate, cooled compartment areas for both food and beverage within the same, portable cooler.

SUMMARY OF THE INVENTION

Therefore it is an object of the invention to provide a combination food and beverage cooler for separately containing items, such as canned goods or canned drinks, in a food compartment, and an otherwise non-contained beverage in a beverage compartment.

It is another object of the invention to provide a combination food and beverage cooler which includes a partition wall for separating the food compartment from the beverage compartment.

It is another object of the invention to provide a combination food and beverage cooler which includes a detachable and refreezable cooler pack positioned between the food compartment and the beverage compartment for cooling the respective compartment areas.

It is another object of the invention to provide a combination food and beverage cooler which includes a drain/fill opening and dispenser tap formed in the beverage compartment for draining/filling or dispensing a beverage.

It is another object of the invention to provide a combination food and beverage cooler that is portable.

It is another object of the invention to provide a combination food and beverage cooler which remains relatively balanced when carried due to the relatively even and uniform distribution of weight throughout the cooler.

These and other objects of the present invention are achieved in the preferred embodiments disclosed below by providing a combination food and beverage cooler including a bottom wall, a plurality of attached side walls, and a top opening defined by the side walls. The bottom wall and side walls substantially enclose a compartment area formed therein. A beverage compartment is positioned in the compartment area and adjacent the bottom wall for storing an otherwise non-contained beverage. The beverage compartment is relatively flat and extends over a relatively large surface area of the compartment area in relation to its volume. A food compartment in the compartment area stores items such as canned goods, canned drinks and other solid food items. A cooling means in the compartment area is positioned between the food compartment and the beverage compartment for cooling the food compartment and the beverage compartment. The cooling means extends over a relatively large surface area of the beverage compartment and the food compartment.

According to one preferred embodiment of the invention, the combination food and beverage cooler includes a partition wall in the compartment area. The partition wall is spaced-apart from the bottom wall and separates the beverage compartment from the food compartment.

Preferably, the partition wall is substantially normal to each of the plurality of side walls.

According to yet another preferred embodiment of the invention, the beverage compartment includes a dispenser formed in and extending through at least one of the plurality of side walls for dispensing a beverage contained in the beverage compartment.

According to yet another preferred embodiment of the invention, the beverage compartment includes a drain/fill plug formed in and extending through at least one of the plurality of side walls for draining or filling the beverage compartment.

According to yet another preferred embodiment of the invention, the dispenser is positioned in and extends through the drain/fill plug. The drain/fill plug includes internal screw threads for receiving the dispenser, and the dispenser has a mating threaded portion for being screwed into the drain/fill plug.

According to yet another preferred embodiment of the invention, the partition wall includes a recess for receiving the cooling means.

Preferably, the cooling means includes a detachable and refreezable cooler pack for placement in the recess of the partition wall.

According to yet another preferred embodiment of the invention, the food compartment further includes a removable tray insert with an inverted recess therein for allowing placement of the tray insert adjacent to the partition wall and over the cooler pack.

According to yet another preferred embodiment of the invention, the combination food and beverage cooler includes a bottom wall, a plurality of attached side walls, and a top opening defined by the side walls. The bottom wall and side walls substantially enclose a compartment area formed therein. A beverage compartment is positioned in the compartment area adjacent the bottom wall for storing an otherwise non-contained beverage. The beverage compartment is relatively flat and extends over a relatively large surface area of the compartment area in relation to its volume. A drain/fill plug and dispenser are formed in and through the beverage compartment. A food compartment adjacent the beverage compartment stores items such as canned goods, canned drinks and other solid food items. A partition wall is spaced-apart from the bottom wall and integrally formed to each of the plurality of side walls. The partition wall is positioned between the food compartment and the beverage compartment, and including a recess therein for containing a cooling means for cooling the food compartment and the beverage compartment. The cooling means extends over a relatively large surface area of the partition wall.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
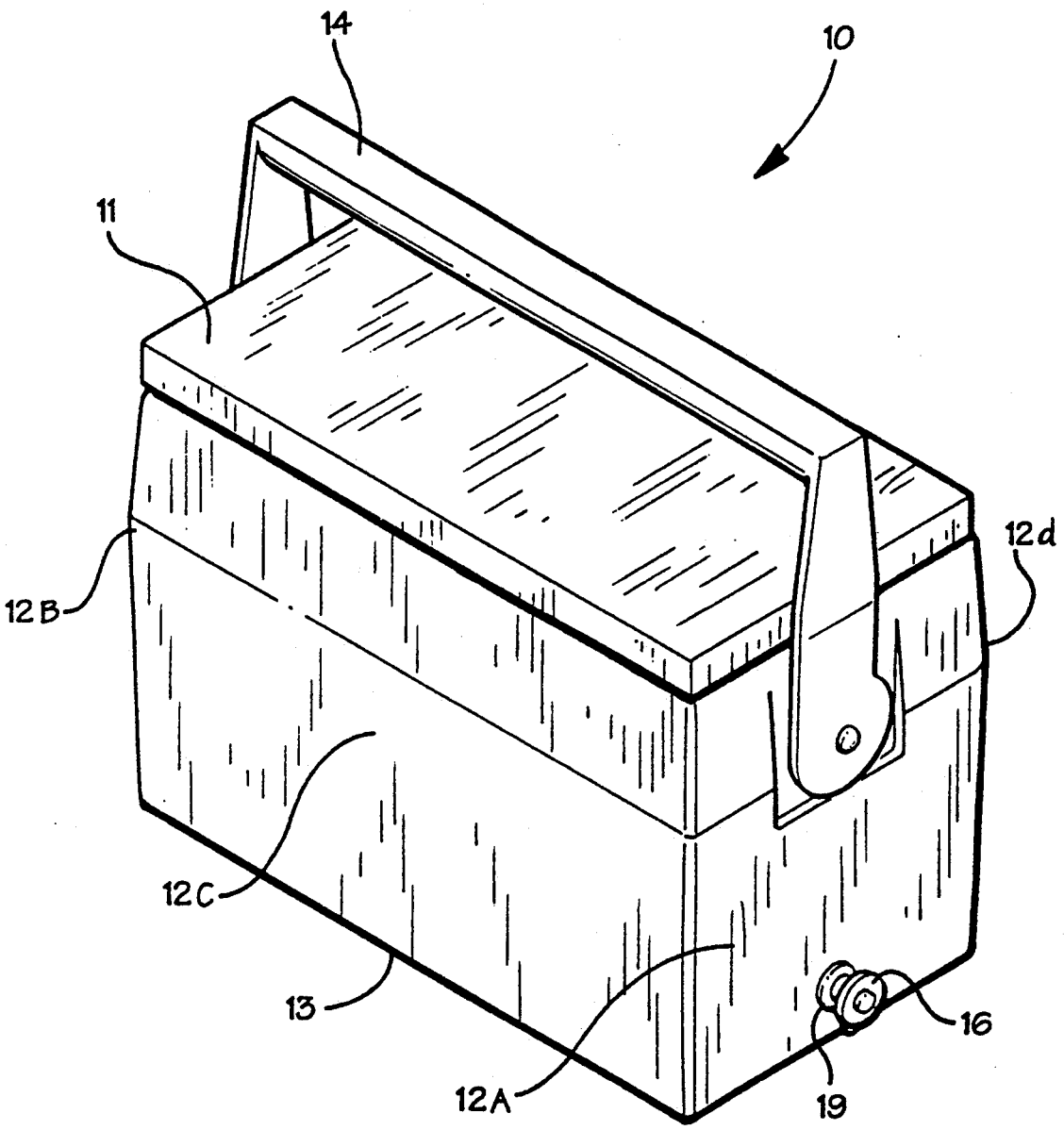
FIG. 1 is a perspective view of a combination food and beverage cooler according to one embodiment of the invention.

Referring now specifically to the drawings, a combination food and beverage cooler according to the present invention is illustrated in FIG. 1 and shown generally at reference numeral 10. The cooler 10 includes a removable top cover 11, side walls 12*a–d*, and a bottom 13. Each of these elements provides quality insulation for maintaining a cool area for food and beverage storage within the cooler 10. The side walls 12*a–d* and bottom 13 are integrally formed, and are made of a durable and resilient thermoplastic such as polyethylene. A handle 14 is pivotally attached to opposing side walls 12*a* and 12*b*. The handle 14 extends up and across the cover 11 when the cooler 10 is being carried by the handle 14. The cover 11 and handle 14 include complementary stud 26 and lip 27 segments, respectively (See FIG. 3). The lip 27 is formed on the inner surface of each end of the handle 14, and the stud 26 is centrally located at corresponding ends of the cover 11. As the handle 14 is pivoted over the cover 11, the lip 27 moves into a position directly above and adjacent the stud 26. Thus, the handle 14 secures the cover 11 to the cooler 10 when the cooler 10 is being carried by the handle 14.

Figure 3:
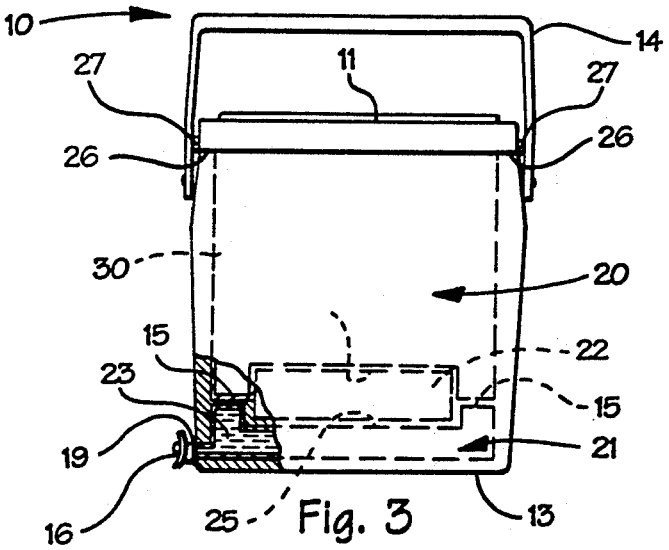
FIG. 3 is a side elevation of the cooler showing the respective elements in phantom with a portion broken away to illustrate the location of the tap dispenser.
Figure 4:
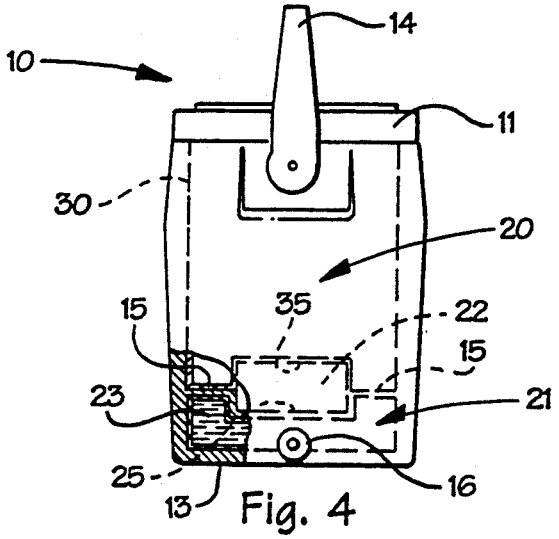
FIG. 4 is a first end elevation of the cooler shown in FIG. 3, with a portion broken away to illustrate the positioning of respective elements contained therein.
Figure 5:
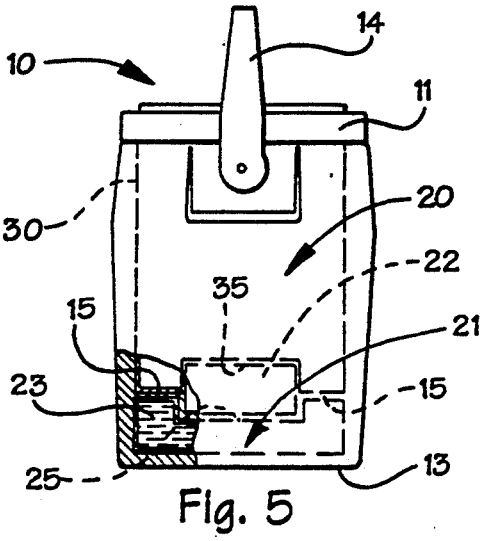
FIG. 5 is a second end elevation of the cooler shown in FIG. 3 with a portion broken away.

As best shown in FIGS. 3, 4, and 5, the cooler 10 includes two compartment areas; an upper food compartment 20 and a lower beverage compartment 21. A partition wall 15 formed within the cooler 10 separates the food and beverage compartments 20 and 21. Preferably, the partition wall 15 is normal to and integrally formed in the inner side of cooler side walls 12*a–d*. In one embodiment of the invention, the partition wall 15 is located 2.5 inches from the bottom 13 of the cooler 10. The food compartment 20 is directly above the partition wall 15, and is approximately equivalent to the area enclosed by a conventional eight-quart cooler. The beverage compartment 21 is directly beneath the partition wall 15, and holds approximately 3 liters of beverage 23.

A center recess 25 is formed in the partition wall 15 for carrying a removable cooler pack 22. The cooler pack 22, according to a preferred embodiment, is approximately 6.75 inches in length, 1.5 inches wide, and 1.5 inches thick. Preferably, the cooler pack 22 is a self-contained and refreezable ice pack with a plastic enclosure to prevent leakage. The cooler pack 22 may be snapped in or otherwise detachably held within the center recess 25 of the partition wall 15.

Figure 2:
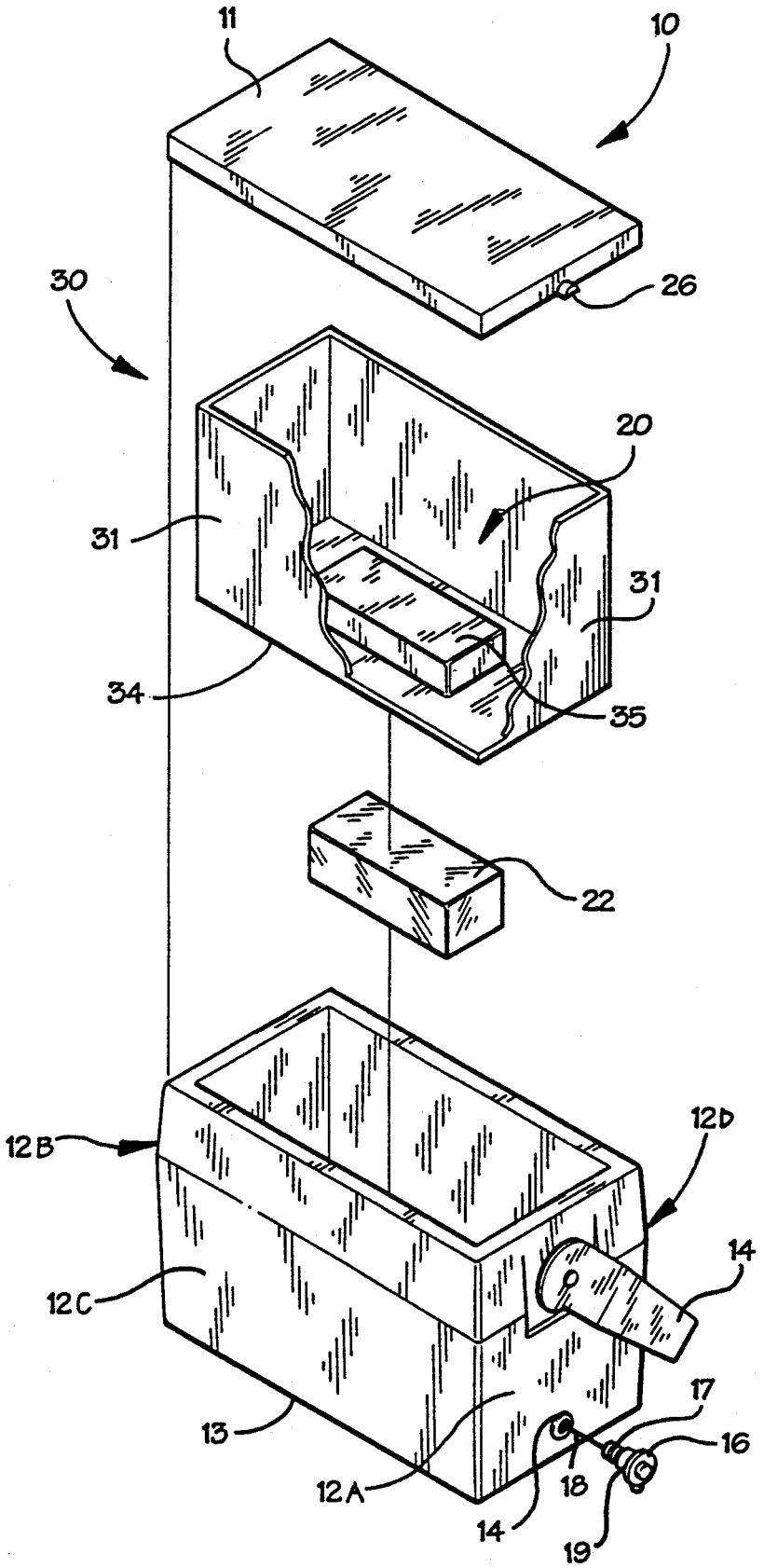
FIG. 2 is an exploded view of the cooler according to the embodiment shown in FIG. 1 showing the freely removable elements of the invention.

As best shown in FIG. 2, the food compartment 20 includes 20 a tray insert 30 shaped to fit within and adjacent the cooler side walls 12*a–d* and partition wall 15. The tray insert 30 has an inverted center recess 35 in its bottom wall 34 essentially corresponding to the center recess 25 of the partition wall 15. According to one embodiment of the invention, the center recess 35 of the tray insert 30 includes small vent holes (not shown) for allowing more efficient passage of cool air from the cooler pack 22 to the food compartment 20.

When in place above the partition wall 15, the tray insert 30 and partition wall 15 enclose and define an area for housing the cooler pack 22, and by removing the tray insert 30, the cooler pack 22 can be easily removed and refrozen for later use. The walls 31 of the tray insert 30 extend to substantially the same height as the side walls 12 of the cooler 10. Thus, the tray insert 30 and cooler pack 22 are securely held in place within the cooler 10 by the top cover 11. According to another embodiment of the invention, the tray insert 30 is simply a thin plastic wall (not shown), including the inverted center recess 35 as described, designed to lock-in over the partition wall 15 to hold the cooler pack 22 within the recess 25 of the partition wall 15. A lap joint type lock is preferable. Both the tray insert 30 and partition wall 15 are made of a relatively thin thermoplastic for allowing cool air produced by the cooler pack 22 to effectively pass therethrough to cool both the food items (not shown) and beverage 23 contained in respective compartment areas of the cooler 10.

The beverage compartment 21, shown in FIGS. 3,4, and 5, is defined by the area directly beneath the partition wall 15 and above the cooler bottom 13. A dispensing means, comprising a tap dispenser 16, is positioned in and through side wall 12*a* (or any other side wall) of the cooler 10 for dispensing the beverage 23 contained in the beverage compartment 21. Preferably, the tap dispenser 16 is substantially recessed in side wall 12*a* to protect the tap dispenser 16 from being sheared-off or otherwise damaged due to normal wear and tear on the cooler 10.

As shown in FIG. 2, the tap dispenser 16 has a threaded end 17 for being screwed into and attached to the side wall 12*a*. The side wall 12*a* has a fill port 18 with a complementary internal screw thread 14 for receiving the threaded end 17 of the tap dispenser 16. A rubber washer 19 acts to seal the attachment of the tap dispenser 16 to the side wall 12*a*.

The tap dispenser 16, according to one embodiment of the invention, also serves as a drainfill means for draining or filling the beverage compartment 21. When the tap dispenser 16 is unscrewed and removed from the side wall 12*a* of the cooler 10, the cooler 10 can be placed on its opposing side wall 12*b* and a desired beverage 23 can be easily filled into the fill port 18 to the beverage compartment 21. The tap dispenser 16 can then be replaced in side wall 12*a* for sealing the fill port 18. To drain the beverage compartment 21, the tap dispenser 16 is simply removed and the cooler 10 is turned to allow the beverage 23 to flow out from the through-portal 18. It is preferable to drain and fill the beverage compartment 21 with the cover 11 securely in place atop the cooler 10. This ensures that the cooler pack 22 and the tray insert 30 will remain in place throughout the process.

According to another embodiment of the invention (not shown), a drain/fill plug is positioned in and through a second side wall 12*b*, separate and distinct from the tap dispenser 16.

A combination food and beverage cooler is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A combination food and beverage cooler, comprising:

(a) a rigid bottom wall, a plurality of attached side walls, a top opening defined by said side walls, and a solid, rigid partition wall fixedly secured within said cooler parallel to and in spaced-apart relation to said bottom wall, and in sealing engagement with said side walls, said partition wall defining a food compartment on one side thereof and an enclosed beverage compartment on an obverse side thereof;

(b) said partition wall having a recess formed therein;

(c) a tray insert removably positioned in said food compartment and supported by said partition wall;

(d) said tray insert having an inverted recess formed therein in mating alignment with the recess in the partition wall to collectively define a cooling compartment, said cooling compartment extending upwardly into the food compartment and downwardly into the beverage compartment; and (e) a reusable cooler pack for being positioned in said cooling compartment.

2. A combination food and beverage cooler according to claim 1, wherein said beverage compartment includes dispenser means formed in and extending through at least one of said plurality of side walls for dispensing a beverage contained in said beverage compartment.

3. A combination food and beverage cooler according to claim 2, wherein said beverage compartment includes drain/fill means formed in and extending through at least one of said plurality of side walls for draining or filling the beverage compartment.

4. A combination food and beverage cooler according to claim 3, wherein said dispenser means is positioned in and extends through said drail/fill means, said drain/fill means including an internal screw thread therein for receiving said dispenser means, and said dispenser means having a threaded portion thereon for being screwed into said drain/fill means.

* * * * *